US006640389B2

(12) United States Patent
Van Klompenburg et al.

(10) Patent No.: US 6,640,389 B2
(45) Date of Patent: Nov. 4, 2003

(54) CASEMENT WINDOW OPERATING ASSEMBLY

(75) Inventors: Marlo G. Van Klompenburg, Pella, IA (US); David J. Vande Steeg, Pella, IA (US); Robert S. Evers, Pella, IA (US); Andrew W. Middleswart, Indianola, IA (US); Bruce A. Baier, Pella, IA (US); Gregory J. Vetter, Owatonna, MN (US)

(73) Assignee: Pella Corporation, Pella, IA (US)

( * ) Notice: Subject to any disclaimer, the term of this patent is extended or adjusted under 35 U.S.C. 154(b) by 0 days.

(21) Appl. No.: 10/255,271

(22) Filed: Sep. 26, 2002

(65) Prior Publication Data

US 2003/0029001 A1 Feb. 13, 2003

Related U.S. Application Data

(62) Division of application No. 09/730,996, filed on Dec. 6, 2000, now abandoned.

(51) Int. Cl.[7] ..... E05F 11/28

(52) U.S. Cl. ..... 16/429; 16/110 R; 49/345; 49/339; 49/279; 49/280

(58) Field of Search ..... 16/429; 49/345, 49/339, 279, 280, 260, 248, 250

(56) References Cited

U.S. PATENT DOCUMENTS

| | | | | |
|---|---|---|---|---|
| 1,274,471 A | | 8/1918 | Todd | |
| 2,355,932 A | | 8/1944 | Walton | |
| 3,007,348 A | | 11/1961 | Barnes | |
| 3,044,478 A | | 7/1962 | Russell | |
| 3,967,511 A | | 7/1976 | Breitschwerdt | |
| 4,155,589 A | | 5/1979 | Kouth | |
| 4,281,526 A | | 8/1981 | Lipschutz | |
| 4,392,330 A | | 7/1983 | Buhr | |
| 4,937,976 A | * | 7/1990 | Tucker et al. | 49/345 |
| 5,006,766 A | | 4/1991 | Yuhas et al. | |
| 5,230,290 A | | 7/1993 | Crossman | |
| D347,569 S | | 6/1994 | Vetter et al. | |
| D350,666 S | | 9/1994 | Wobschall et al. | |
| 5,400,473 A | | 3/1995 | Delman | |
| D361,490 S | | 8/1995 | Vetter | |
| 5,467,503 A | | 11/1995 | Nolte et al. | |
| D365,513 S | | 12/1995 | Vetter et al. | |
| D369,741 S | | 5/1996 | Harrison et al. | |
| 5,551,316 A | | 9/1996 | Blank | |
| D375,042 S | | 10/1996 | Anderson et al. | |
| 5,560,082 A | | 10/1996 | Vetter | |
| D375,254 S | | 11/1996 | Anderson et al. | |
| D375,445 S | | 11/1996 | Harrison et al. | |
| D375,674 S | | 11/1996 | Anderson et al. | |
| D379,917 S | | 6/1997 | Vetter et al. | |
| D390,454 S | | 2/1998 | Vetter et al. | |
| 5,765,308 A | | 6/1998 | Anderson et al. | |
| 5,813,171 A | | 9/1998 | Piltingsrud | |
| D408,274 S | | 4/1999 | Vetter et al. | |
| D408,729 S | | 4/1999 | Virklet et al. | |
| 5,937,582 A | | 8/1999 | Taylor | |
| D450,237 S | * | 11/2001 | Vande Steeg et al. | D8/400 |

FOREIGN PATENT DOCUMENTS

| | | |
|---|---|---|
| GB | 2082518 A | 3/1982 |

* cited by examiner

*Primary Examiner*—Anthony Knight
*Assistant Examiner*—Enoch Peavey
(74) *Attorney, Agent, or Firm*—Faegre & Benson, LLP

(57) ABSTRACT

An operating assembly for a casement window includes a folding crank handle and cover assembly that are located on the exterior surface of a trim piece on the sill of the window frame. The crank handle is attached to the drive shaft of the operator of the assembly in such a way that the handle may be folded down into a low-profile position in which the knob of the handle projects into a receiving pocket in the cover. An integral flap on the handle extending beyond the knob covers the pocket when the knob is received therein. Internal detent projections within the pocket yieldably retain the knob so as to provide for snap fit reception of the folded handle into its home position. Finger depressions in side-walls of the cover on opposite sides of the pocket facilitate gripping of the edges of the handle for unfolding.

45 Claims, 9 Drawing Sheets

CASEMENT WINDOW OPERATING ASSEMBLY

This application is a divisional application of, and claims priority to, a U.S. patent application Ser. No. 09/730,996, entitled CASEMENT WINDOW OPERATOR HAVING FOLDING CRANK HANDLE, filed on Dec. 6, 2000, now abandoned.

TECHNICAL FIELD

The present invention relates to the field of fenestration products and, more particularly, to an operating assembly used to swing open and closed the sash of a casement window.

BACKGROUND

Casement windows employ a sash that swings open and closed about an upright axis along one vertical edge of the sash. Operator assemblies for effecting that swinging motion have been available for many years in various forms. See, for example, U.S. Pat. Nos. 4,392,330 and 5,006,766 owned by the assignee of the present invention. Folding crank handles on such operator assemblies have also been commercially available for some time. However, such prior art arrangements have not been optimal with respect to aesthetics, ease of use, lack of interference with window treatments, reliability and other factors. Accordingly, the present invention is provided to overcome these deficiencies in the prior art and to furnish additional benefits.

SUMMARY OF THE INVENTION

The present invention provides a casement window operator assembly in which the crank handle can be folded down into a low-profile, unobtrusive storage position in which the gripping knob of the handle is fully concealed and out of the way so as to provide enhanced aesthetic appeal and avoidance of interference with various window treatments and physical contact with persons in the vicinity. The structural features and relationships of the cover and folding crank handle assembly are such that when the crank handle is folded up, it is not immediately apparent to the casual observer that the article being observed, with its graceful lines and unobtrusive appearance, can be quickly and easily transformed into a utilitarian apparatus having the function of opening and closing the sash when manually operated.

The operator of the assembly, including a linkage to the sash, a helical gear and an input worm gear, is located in a recess in the sill of the window. A trim piece on the sill is notched out to expose the operator, but a decorative cover overlies the notch to conceal the operator. Through a hole in one end of the cover, an input drive shaft from the worm gear projects outwardly and upwardly beyond the top wall of the cover where it is operably coupled with the folding crank handle assembly. An adapter or mount on the handle assembly is fixed to the drive shaft and provides a pivotal support for crank handle itself, which can thereby be swung between a folded down position essentially flush with the cover and a folded out operating position in which the handle projects outwardly from the drive shaft to assume the functional role of an operating crank. The crank handle has a knob projecting outwardly from its underside which is gripped by the user when winding the crank handle around the axis of the drive shaft to swing the sash open and closed. When the crank handle is in its folded position, the knob projects into a receiving pocket in the cover so as to allow the handle to be substantially flush against the top wall of the cover and completely within its lateral margins. A flap extension of the handle projects beyond the knob and overlies the pocket when the handle is folded down, thus completely concealing the knob and contributing to compactness of the assembly and the smooth, uncluttered and unobtrusive nature thereof.

The handle tapers in thickness as its operating end in the vicinity of the knob is approached so as to compensate for the increased height of the cover in that same area which is necessary to provide for the relatively deep, knob-receiving pocket. As a result of the thinning down of the handle in the vicinity of the knob, the installed cover and crank handle assembly assumes a generally symmetrical overall configuration when the handle is folded down. The thinned down flap portion of the handle is slightly upturned away from the knob so as to avoid interference with the user's index finger and thumb when the knob is gripped and the handle is rotated to open or close the sash.

The pocket is provided with internal projections that serve as detents for the knob when the handle is folded down. As the knob is pushed into the recess, it engages the projections, and the interior wall of the pocket yields slightly so that a positive, secure snap action fit is sensed by the user. At the other extreme, interengaging surfaces between the mounting end of the handle and the adapter mount on the drive shaft provide positive limits for unfolding of the crank handle and serve as an indication of when the handle has been unfolded to its optimum operating position. Finger depressions in the cover on opposite sides of the pocket facilitate gripping of the thinned down flat portion by the user when the handle is to be unfolded.

One alternative embodiment of the invention includes an operator designed for use with egress windows in which the upright pivot axis of the sash remains adjacent the side of the upright frame member of the window throughout opening and closing of the sash, as contrasted to the standard situation in which the pivot axis of the sash shifts inwardly along the sill toward the mid-portion thereof and away from the upright side of the window frame as the sash is opened and closed. The worm gear of the operator is disposed close beside the helical gear and projects upwardly away from the helical gear at an oblique angle toward the cover and crank handle assembly. A long link arm fixed to the helical gear and rotatable therewith, generally in the same plane as the helical gear, transfers the rotary motion of the helical gear to the sash for swinging the sash open and closed. When the sash is closed, the long link arm lies along and generally parallel to the sill while crossing over the worm gear. A clearance hump in the arm allows the arm to rest in such a crossover relationship to the worm gear without interengaging with the worm gear or the housing in which it is contained.

DETAILED DESCRIPTION

Figures 1, 1A:
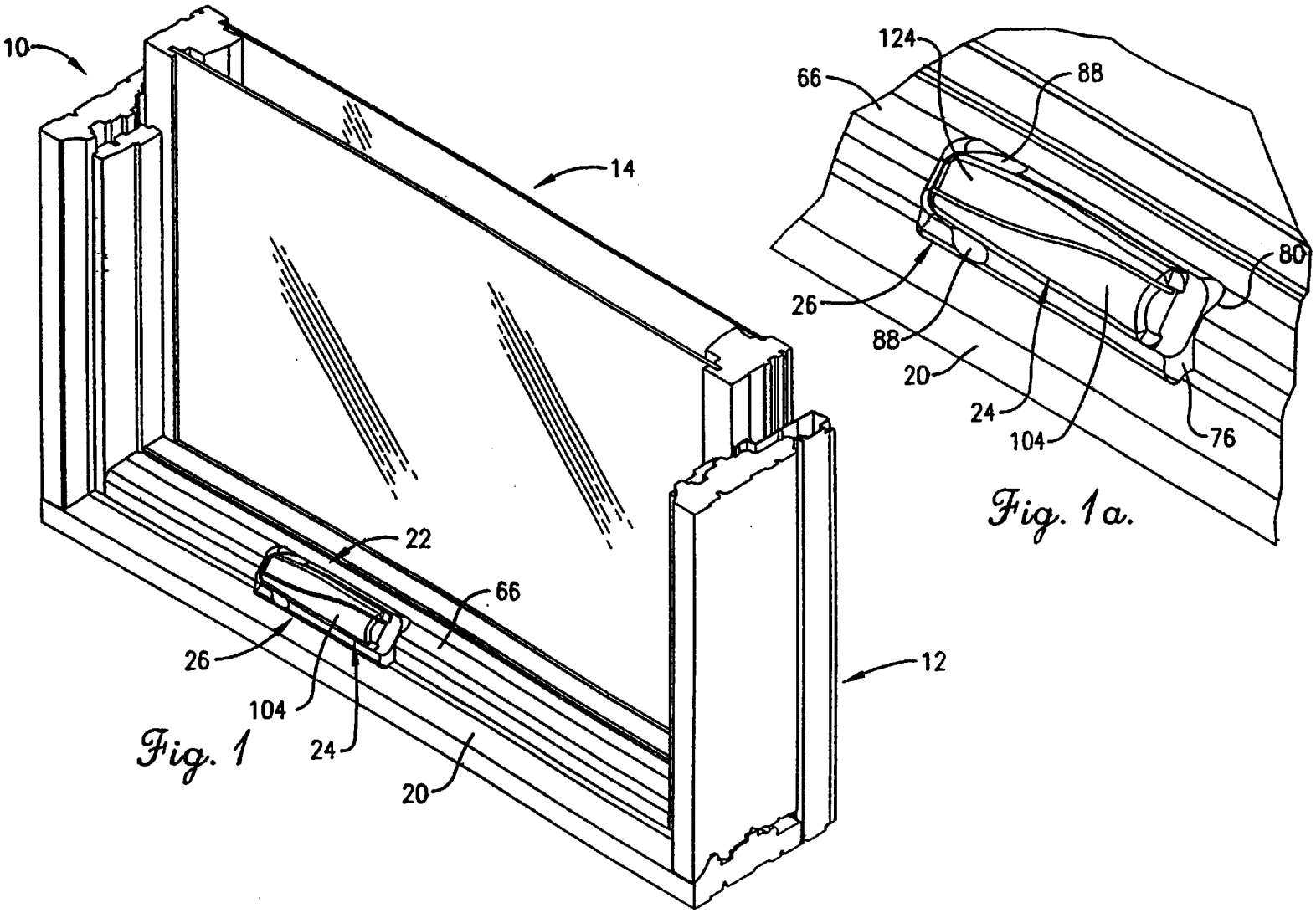
FIG. 1 is a fragmentary front perspective view of a casement window employing an operator assembly in accordance with the principles of the present invention, the crank handle thereof being shown in its fully folded down position and the sash being shown in its closed position.
FIG. 1*a* is a fragmentary enlargement of FIG. 1.
Figures 2, 2A:
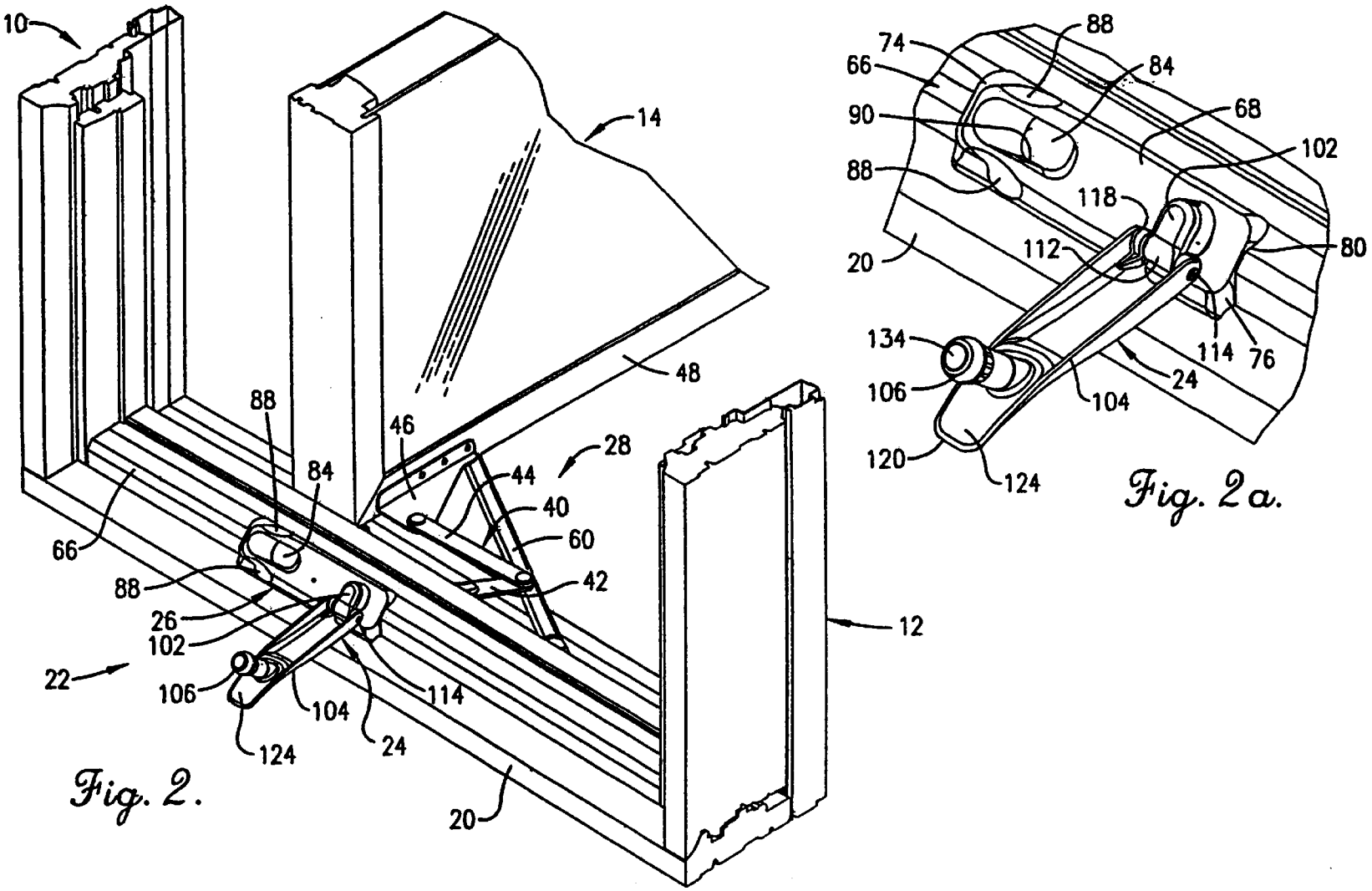
FIG. 2 is a fragmentary perspective view of the casement window and operator assembly of FIG. 1, but showing the sash fully opened and the crank handle unfolded into its operating position.
FIG. 2*a* is a fragmentary enlargement of FIG. 2.
Figure 3:
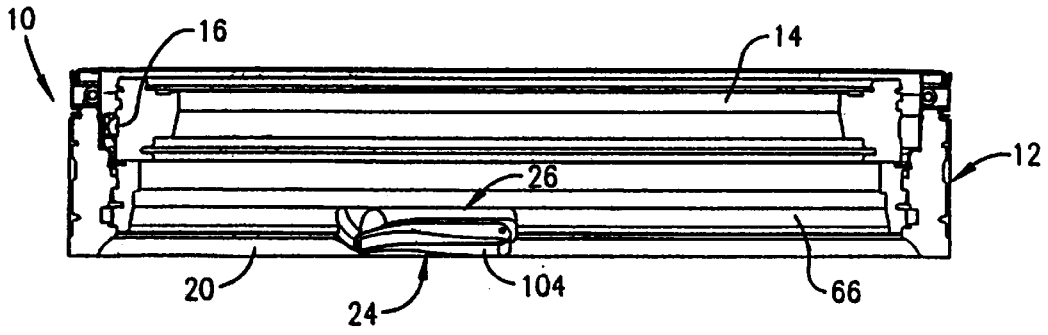
FIG. 3 is a fragmentary top plan view of the casement window and operator assembly of FIG. 1, with the sash fully closed and the crank handle folded down.
Figure 4:
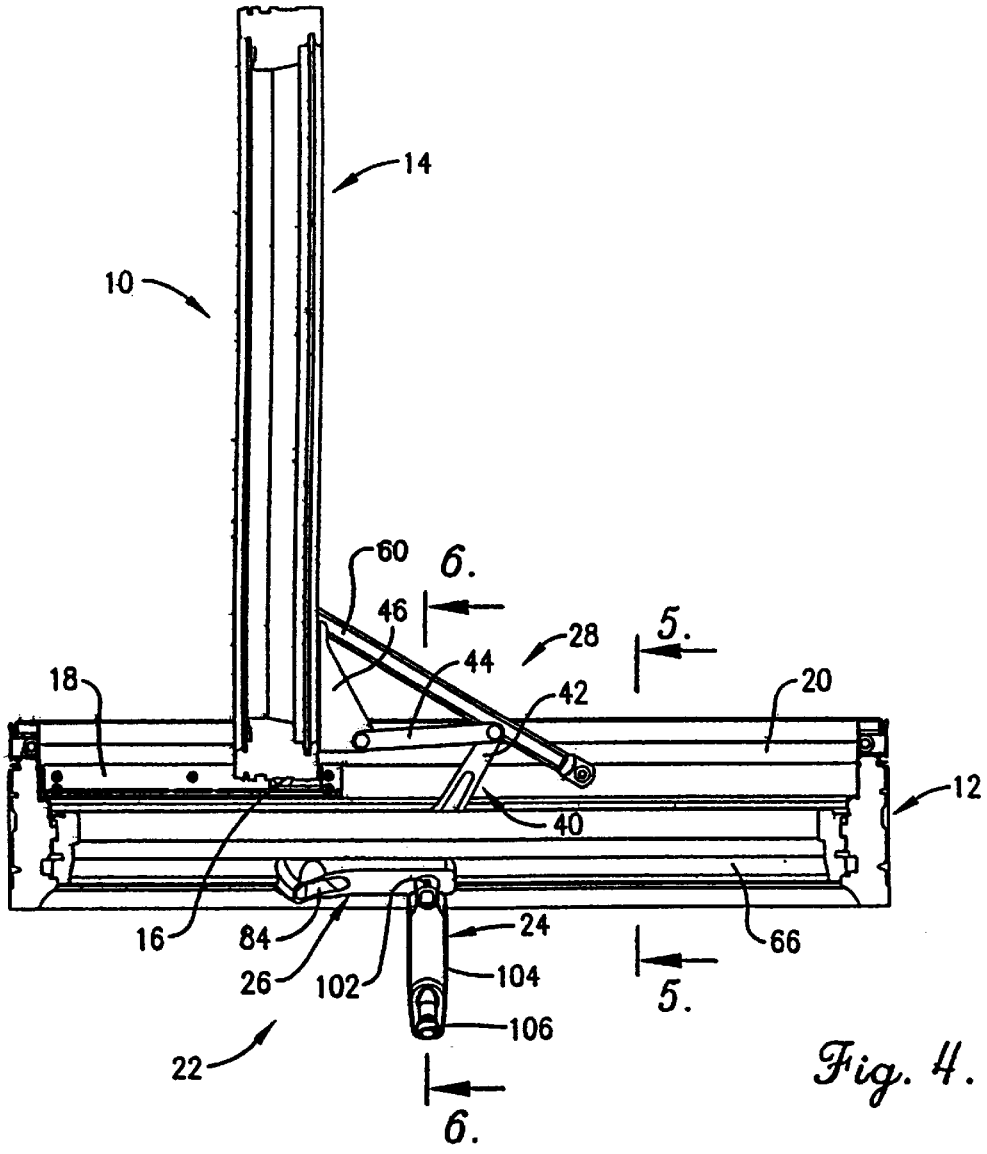
FIG. 4 is a fragmentary top plan view of the casement window and operator assembly in the opened and unfolded condition of FIG. 2.

As well understood by those skilled in the art, the casement window 10 includes an open box-like, rectangular frame 12 and a sash 14 that is swingable between closed and opened positions illustrated in FIGS. 1 and 2 respectively (see also FIGS. 3 and 4). The sash 14 swings about an upright axis defined in part by a lower pivot 16 (FIG. 4) that is shifted left and right along a track 18 on sill 20 of window frame 12 as sash 14 is opened and closed. An operator assembly broadly denoted by the numeral 22 is operably coupled with sash 14 for effecting opening and closing thereof.

Figure 5:
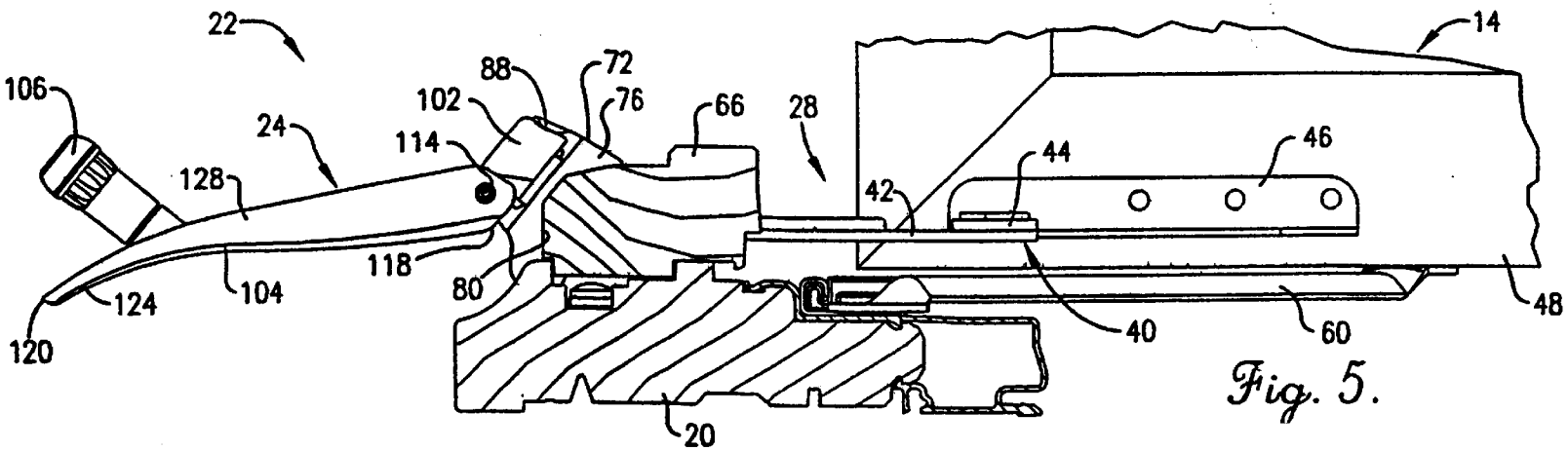
FIG. 5 is an enlarged, fragmentary cross-sectional view through the window with the sash fully opened and the crank handle unfolded, corresponding to the condition of things in FIG. 4 and taken substantially along line 5—5 of FIG. 4.
Figure 7:
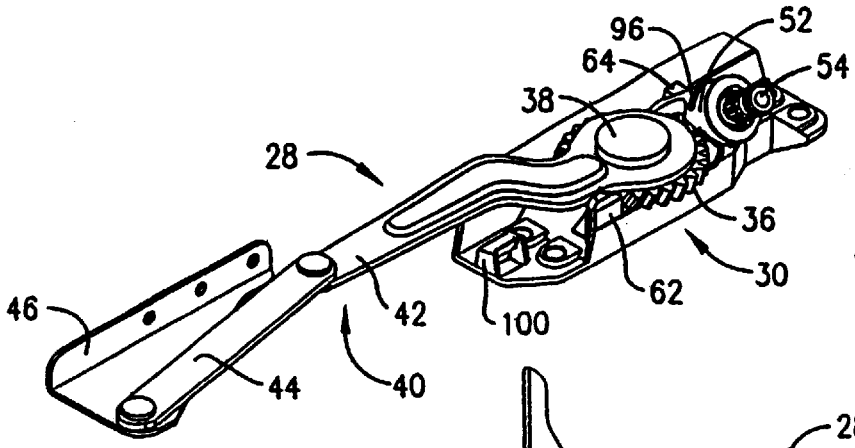
FIG. 7 is a perspective view of the operator used in the operator assembly of FIGS. 1–6, the swing linkage of the operator being illustrated in its closed position corresponding to the fully closed position of the sash.
Figure 8:
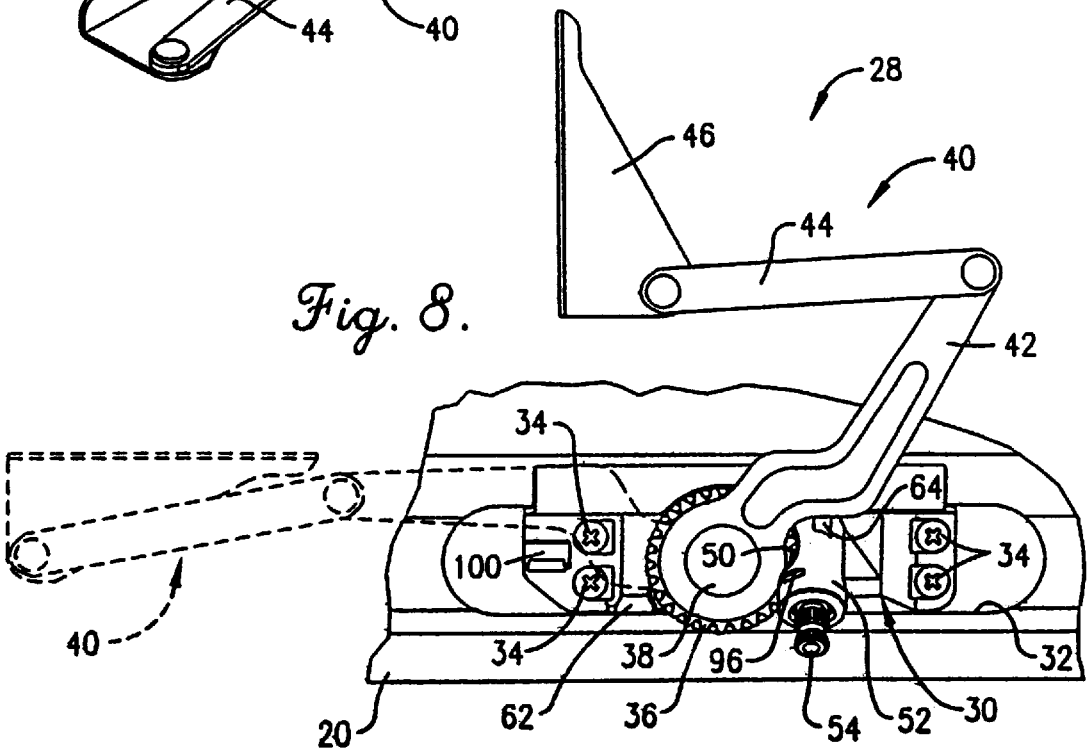
FIG. 8 is a fragmentary top plan view of the operator of FIG. 7, mounted on the window sill and illustrating the swing linkage in its fully opened position corresponding to the sash open position, the phantom lines corresponding to the closed position of the swing linkage.
Figure 10:
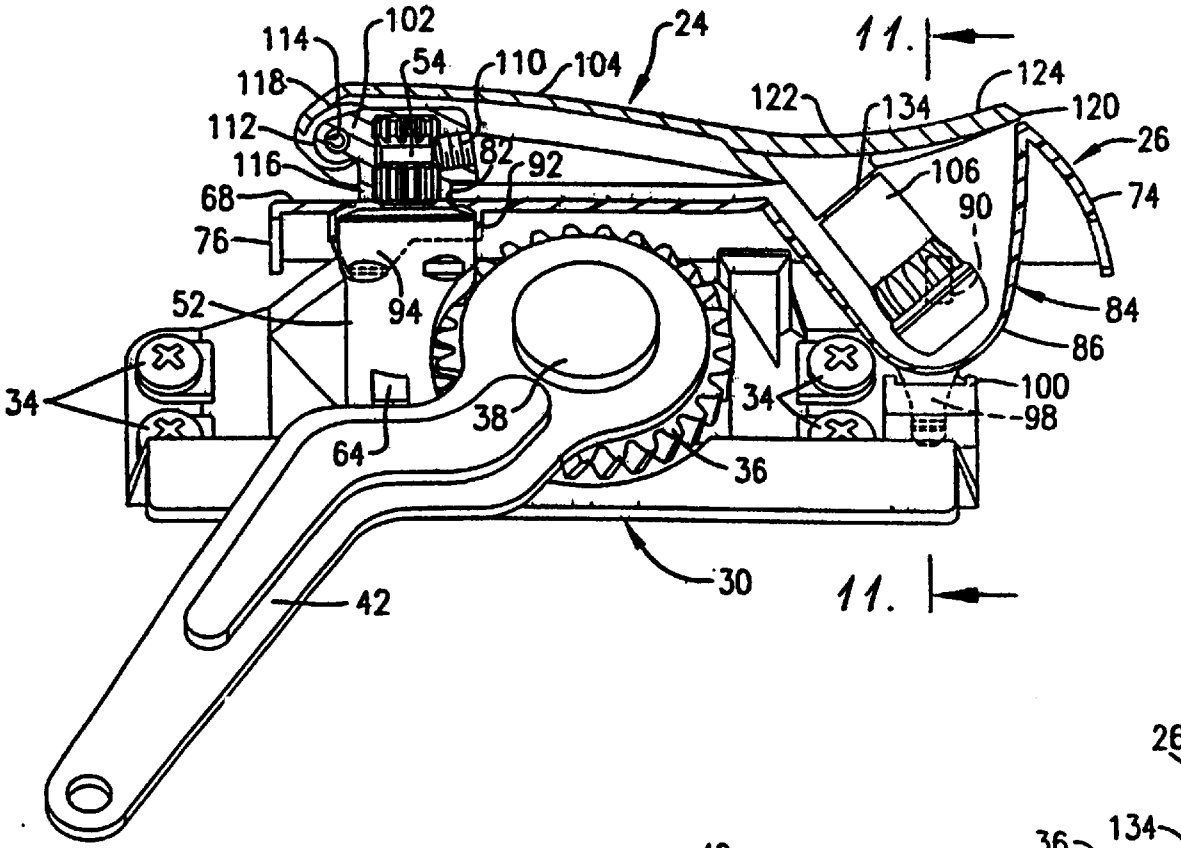
FIG. 10 is an enlarged top, front perspective view of the operator assembly with one link of the swing linkage removed for clarity and with the cover and crank handle assembly shown in cross-section to reveal details of construction.

Operator assembly 22 broadly includes three major subassemblies, i.e., a crank handle assembly 24, a cover 26, and an operator 28 that translates the winding motion of the crank handle assembly 24 into pushing and pulling motion against the sash 14. Dealing first with the operator 28, such mechanism is illustrated in isolation in FIGS. 7 and 8 to facilitate an understanding of its construction. An elongated, cast metal base plate 30 of the operator comprises a support for other components of the operator and has its longitudinal axis extending parallel to the longitudinal axis of the sill 20 when plate 30 is installed in a recess 32 in sill 20 as illustrated in FIG. 8. Screws 34 (FIGS. 8, 10 and 11) securely fasten base plate 30 to sill 20. A flat bevel gear 36 is rotatably secured to base plate 30 by an upright stud 38. Swing linkage 40 includes an inner generally Z-shaped link arm 42 that is fixed at its inner end to the top surface of bevel gear 36 so that link arm 42 rotates with bevel gear 36 when gear 36 is operated. Linkage 40 further includes an outer link arm 44 pivotally secured to the outer end of inner arm 42, the outer arm 44 being pivotally connected at its outer end to a bracket 46 that is in turn secured to the inside face of the lower rail 48 of sash 14 as illustrated in FIGS. 2, 5 and 6.

Figure 9:
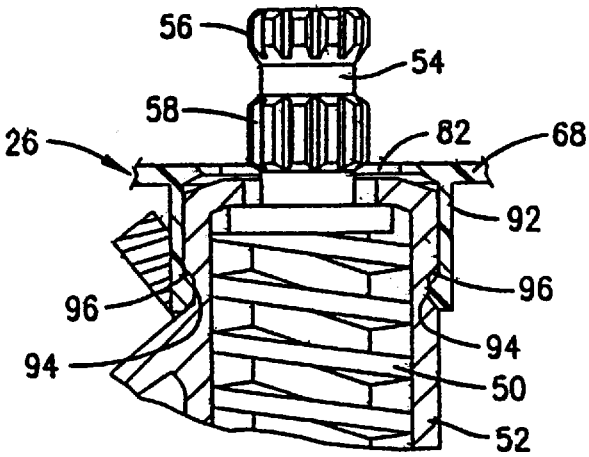
FIG. 9 is an enlarged, fragmentary detail view of the cover and drive shaft area of the operator assembly illustrating details of construction, with parts being shown in cross-section for clarity.

Operator 28 further includes a worm gear 50 (see also FIGS. 6 and 9) contained within a generally cylindrical housing 52 integral with and forming a part of base plate 30. Housing 52 and worm gear 50 are disposed immediately beside helical gear 36 and project upwardly and outwardly at an oblique angle to the plane of the base plate 30 and to the plane of the sill 20. Housing 52 has a cutout (FIG. 8) in its sidewall that permits the worm gear 50 to engage and operably mesh with helical gear 36. An input drive shaft 54 rigidly affixed to worm gear 50 projects axially therefrom beyond housing 52 for the purpose of supplying input driving power to operator 28. Drive shaft 54 carries a pair of splined collars 56 and 58 for the purpose of drivingly connecting the crank handle assembly 24 with operator 28 as hereinafter explained. A strut 60 (FIGS. 2, 4, 5 and 6) is pivotally connected at an inner end to the sill 20 and at an outer in to the underside of sash rail 48 to assist swing linkage 40 in causing the sash to swing and the pivot point for sash 14 to shift along sill 20 during the opening and closing action. Inner link arm 42 engages an upstanding abutment 62 adjacent the front of base plate 30 when arm 42 is in the home position parallel to the longitudinal axis of sill 20 to prevent overswinging of linkage 40. At the other extreme, inner link arm 42 engages a stop 64 on housing 52 to determine the fully opened position of linkage 40.

Figure 6:
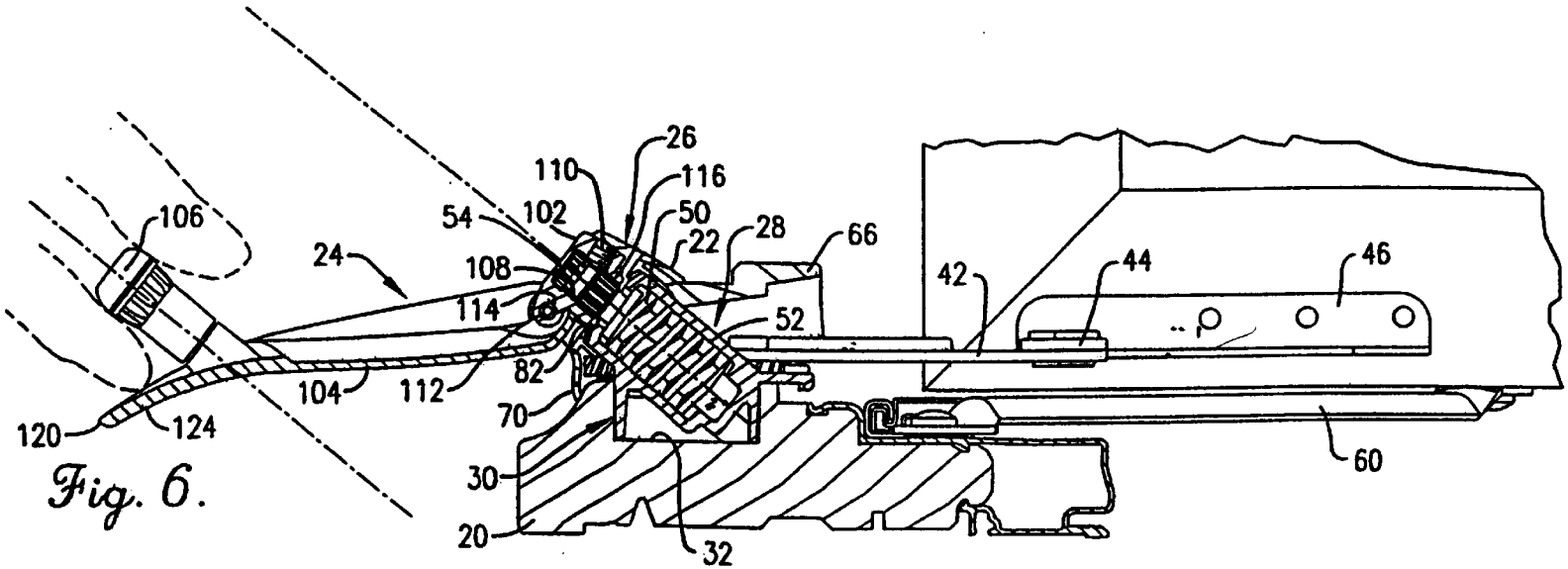
FIG. 6 is a cross-sectional view of the window and operator assembly taken substantially along line 6—6 of FIG. 4.

As illustrated in FIGS. 1–6, a trim piece 66 forming a part of the window frame 12 overlies and is fastened to sill 20. Trim piece 66 is notched out in the region that would otherwise overlie and interfere with base plate 30 and the operating components thereon such that worm gear 50 projects upwardly and outwardly from sill 20 through trim piece 66 at approximately a 30 degree angle as illustrated in FIG. 6. Cover 26 overlies and conceals the notched out portion of trim piece 66 so that base plate 30 and its various operating components are likewise shielded from view. As illustrated in several of the figures, cover 26 sits on trim piece 66 on an incline relative to horizontal, essentially at right angles with the drive shaft 54 of operator 28.

Preferably, cover 26 comprises a molded product constructed from synthetic resinous material. With reference to FIGS. 17–21, as well as other figures, it will be seen that cover 26 comprises a generally hollow, shell-like article having a concave underside and a flat top wall 68. Sidewalls 70 and 72 converge upwardly toward and intersect with top wall 68 so that top wall 68 spans sidewalls 70, 72. Cover 26 further includes a pair of opposite end walls 74 and 76 that converge upwardly and inwardly to the top wall 68. End walls 74 and 76 have notches 78 and 80 therein configured to matingly engage the beveled front edge of the trim piece 66 as illustrated particularly in FIGS. 1*a*, 2*a* and 5.

At the mounting end of cover 26, in a straight portion 68*a* thereof, top wall 68 has a hole 82 (FIGS. 9 and 17) through which the drive shaft 58 extends when cover 26 is in place on trim piece 66. The other end of top wall 68 curves gently upwardly and outwardly to present an upslope portion 68*b* leading from the straight portion 68*a*. An internal pocket 84 is located in the upslope portion 68*b* and includes an interior wall 86 that depends from the upslope portion 68*b* and projects downwardly below the lower extremity of sidewalls 70, 72 and end walls 74, 76. Sidewalls 70, 72 gradually increase in height as the wall 74 is approached so as to maintain a straight lower edge and yet intersect along the upper edge with top wall 68. Similarly, end wall 74 adjacent pocket 84 is substantially taller than end wall 76 adjacent the hole 82. A pair of generally vertically oriented finger depressions 88 are provided in the opposite sidewalls 70, 72 on opposite sides of pocket 84, and a pair of opposed projections 90 on interior pocket wall 86 (FIGS. 10, 11 and 17) serve as yieldable detents for snap-action retention of the knob 106 of handle assembly 24 as will hereinafter be explained. It will be noted that interior wall 86 is slightly resiliently yieldable laterally inwardly and outwardly to provide the desired detent effect.

On the underside of cover 26, a depending collar 92 (FIG. 9) coaxial with hole 82 circumscribes the upper end of worm gear housing 52 and has a pair of opposed lugs 94 that snap into mating notches 96 on the housing 52 to yieldably retain cover 26 in place on the trim piece 66. Additionally, a pair of depending, opposed lugs 98 on the exterior of pocket wall 86 yieldably hook over an upstanding tab 100 on base plate 30 to provide additional snap action retention of cover 26 when the cover is pressed into position on trim piece 66 in overlying relationship to the base plate 30.

The crank handle assembly 24 includes two major components, i.e., an adapter mount 102 that serves to operably connect the handle assembly 24 to drive shaft 54, and a crank handle 104 itself that is pivotally attached to mount 102 for swinging motion between the folded position of FIGS. 1 and 1*a* and the unfolded position of FIGS. 2 and 2*a*. Handle 104 includes an operating knob 106 projecting from the underside thereof which can be gripped by the operator once handle 104 is unfolded so as to provide a means of winding the handle 104 about the axis of drive shaft 54 and thereby operating operator 28 to open and close sash 14.

Dealing first with mount 102, it will be seen that mount 102 is shaped somewhat in the nature of a button or cap and has an internally splined bore 108 (FIG. 6) that matingly receives the splined collars 56, 58 of drive shaft 54, thereby drivingly coupling mount 102 with drive shaft 54. A set screw 110 in the side of mount 102 may be tightened down until its innermost tip end rests in the annular valley between collars 56 and 58 so as to preclude axial movement of mount 102 relative to drive shaft 54. A laterally outwardly projecting nose 112 on the opposite side of the mount 102 has a transverse bore that receives a roll pin 114 which projects outwardly beyond opposite side terminations of the nose 112. Roll pin 114 thus serves as a pivot pin for handle 104 about which the handle can swing between its folded and unfolded positions. Mount 102 has an integral, annular boss 116 depending from the underside thereof and circumscribing the bore 108. Boss 116 is of reduced size relative to the remainder of mount 102 and is somewhat smaller in diameter than hole 82 in cover 26 so that, depending upon manufacturing tolerances, boss 116 may fit down into hole 82 and thus reduce the distance by which the handle assembly 24 and cover 26 project out from window frame 12, i.e., reduce their effective profile. Mount 102 is preferably constructed from cast metal.

Crank handle 104 comprises an elongated body preferably formed of cast metal. It has a mounting end broadly denoted by the numeral 118, and an operating end broadly denoted by the numeral 120. The top surface of handle 104 is gently transversely arched from the mounting end 118 to a point generally adjacent knob 106 and is also gently arched in a longitudinal sense between the same points. The top surface is slightly reversely curved to present a gentle dip 122 opposite to the knob 106, from where the body continues upwardly and outwardly in the form of a flap extension 124 that is slightly upwardly curled. It will be seen that the handle 104 tapers in thickness from mounting end 118 toward operating end 120, the handle being preferably concave on its underside between mounting end 118 and knob 106 so as to present a pair of opposite sidewalls 126 and 128 that generally taper in height as operating end 120 is approached. Thus, overall, handle 104 is thinner in the vicinity of extension flap 124 than in the vicinity of mounting end 118. A pair of transverse, aligned holes 130 in sidewalls 126 and 128 adjacent mounting end 118 receive opposite ends of the roll pin 114 to pivotally attach handle 104 to mount 102. A transverse notched edge surface 132 at mounting end 118 of handle 104 is positioned to buttingly engage the surface of boss 116 on mount 102 when handle 104 is fully unfolded, as shown in FIG. 6, so as to prevent further unfolding of the handle.

The knob 106 is freely rotatable about a spindle 134 that projects from the underside of handle 104 at an oblique angle relative to the main portion of the body of handle 104 between mounting end 118 and the dip 122. The oblique attitude of spindle 134 thus correspondingly causes knob 106 to project obliquely from the underside of handle 104 in the same manner. The upturned nature of flap 124, being up and away from the obliquely projecting knob 106, provides more clearance for the user to grip knob 106 and manipulate handle 104 than would otherwise be the case, all as shown best in FIGS. 6 and 10. Pocket 84 is sized and configured to fully receive knob 106 as handle 104 is swung to its folded down position, and it will be noted that flap 124 fully covers and conceals the otherwise visible open area of pocket 84 when handle 104 is folded down. It will be noted also that the gentle upward curvature of flap 124 generally matches the gentle curving upslope of the upslope portion 68*b* of cover 26 so that handle 104 blends in smoothly with cover 26 along the full length thereof when handle 104 is folded down. It is to be noted also from FIG. 19 that handle 104 is maintained fully within the outline of cover 26 when viewed in plan, thus contributing to a smooth, uncluttered design and providing a lack of protruding structures. Generally speaking, the contours and lines of handle 104 blend in smoothly with those of the cover 26 so that a sleek, smooth overall visual effect is obtained.

Operation

Use of the operator assembly 22 should be apparent from the foregoing description. When the crank handle 104 is folded down against the cover 26 as shown in FIGS. 1, 1*a* and 18–21, handle 104 and cover 26 became a smooth, low-profile device with clean, graceful lines. The handle 104 and cover 26 tend to blend together as if comprising a single structure, and the fact that handle 104 serves a functional purpose, as a means for mechanically operating sash 14, is not immediately apparent to the casual observer. Knob 106 is fully concealed by flap 124 within the deep pocket 84 and is also safely tucked away in a protected position where it cannot catch on window treatments or persons in the immediate vicinity.

Furthermore, it will be appreciated that handle 104 can be folded down and retained by the pocket 84 when sash 14 is in any position, not just when fully closed. Thus, when sash 14 is only part way open, for example, handle 104 can be folded down with knob 106 inserted into pocket 84 to gain the benefits of a compact operating unit even at those times. Moreover, sash 14 cannot move out of its selected partially opened position when knob 106 is received within pocket 84.

Figure 11:
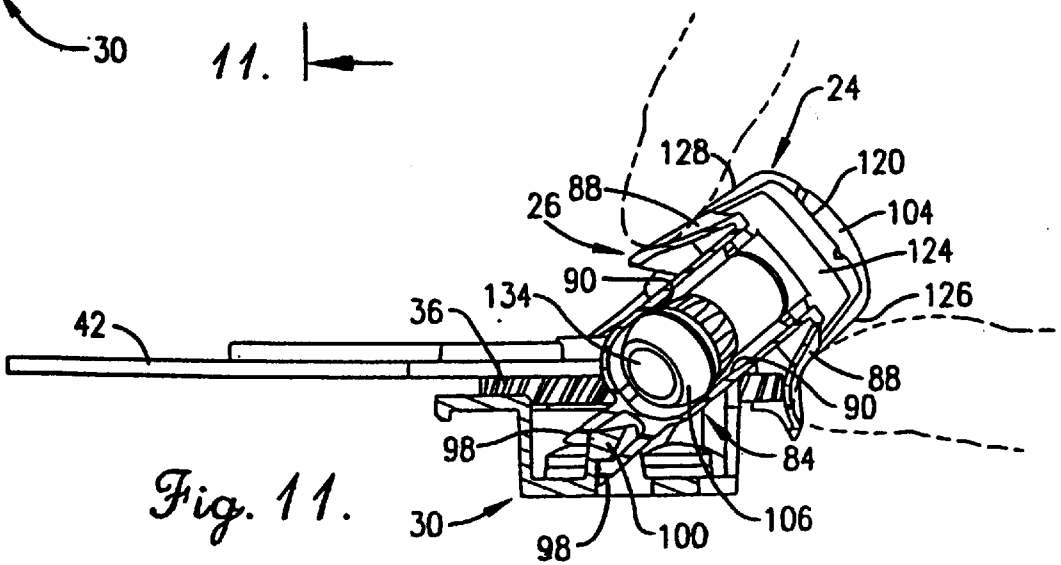
FIG. 11 is a transverse cross-sectional view through the operator assembly taken substantially along line 11—11 of FIG. 10, and illustrating the manner in which the finger depressions on opposite sides of the cover in the area of the knob-receiving pocket facilitate gripping and unsnapping of the handle from its folded down position.

To open or close sash 14, the user merely places their thumb and index finger within depressions 88, as illustrated in FIG. 11, so as to grip opposite sides of the flap 124 of handle 104. A light tug on handle 104 will then unsnap knob 106 from detent projections 90 within pocket 84, allowing the handle 104 to be swung about pin 114 until edge surface 132 at the mounting end 118 of handle 104 engages boss 116 on mount 102. Handle 104 will then be at its fully unfolded position, as illustrated in FIGS. 2, 2*a* and 4–6, wherein the axis of rotation of knob 106 is essentially parallel to the axis of rotation of drive shaft 54, as illustrated best in FIG. 6. By gripping knob 106 between the thumb and index finger, as illustrated in FIG. 6, handle 104 may then be wound about the axis of drive shaft 54, which causes operator 28 to swing and shift sash 14 to its opened position. Once sash 14 is opened or closed to the extent desired, handle 104 may be easily snapped back down into its folded position to once again conceal knob 106 and present the desired unobtrusive, compacted, low-profile configuration. It will be appreciated that during the winding action of handle 104, the flap 124 does not interfere with the user's thumb and index fingers due to the fact that flap 124 curls gently outwardly and upwardly away from knob 106, as illustrated in FIG. 6. Yet, flap 124 is fully capable of achieving its purpose of concealing knob 106 and pocket 84 when handle 104 is folded down.

Alternative Embodiment

FIGS. 12–16 are directed to an alternative embodiment having particular utility for use with windows commonly referred to as "egress windows." In an egress window, the sash swings about a vertical pivot that does not shift along the sill as the sash opens, but instead remains at one end of the sill adjacent the upright member of the window frame.

Figure 12:
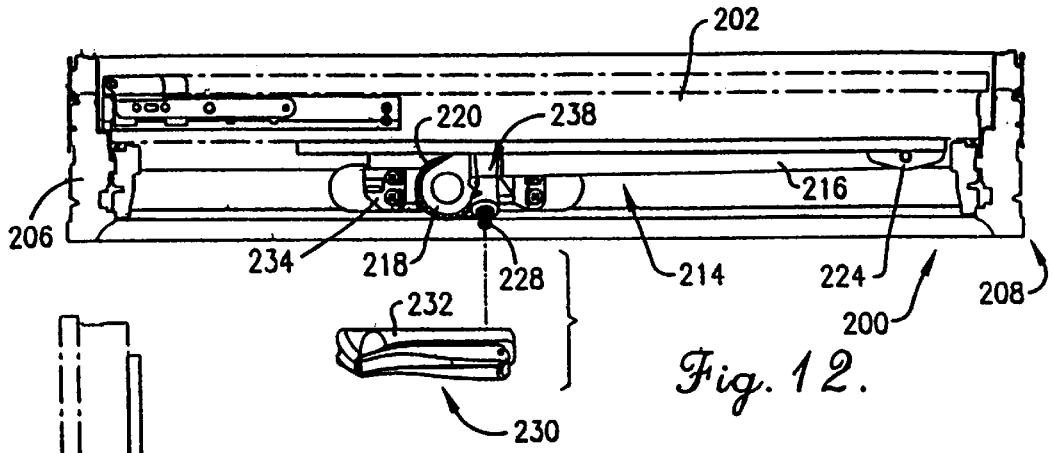
FIG. 12 depicts an alternative embodiment especially suited for egress windows, the sash being illustrated fully closed and the single swing link arm of the operator being in its closed position extending parallel to the sill.
Figure 13:
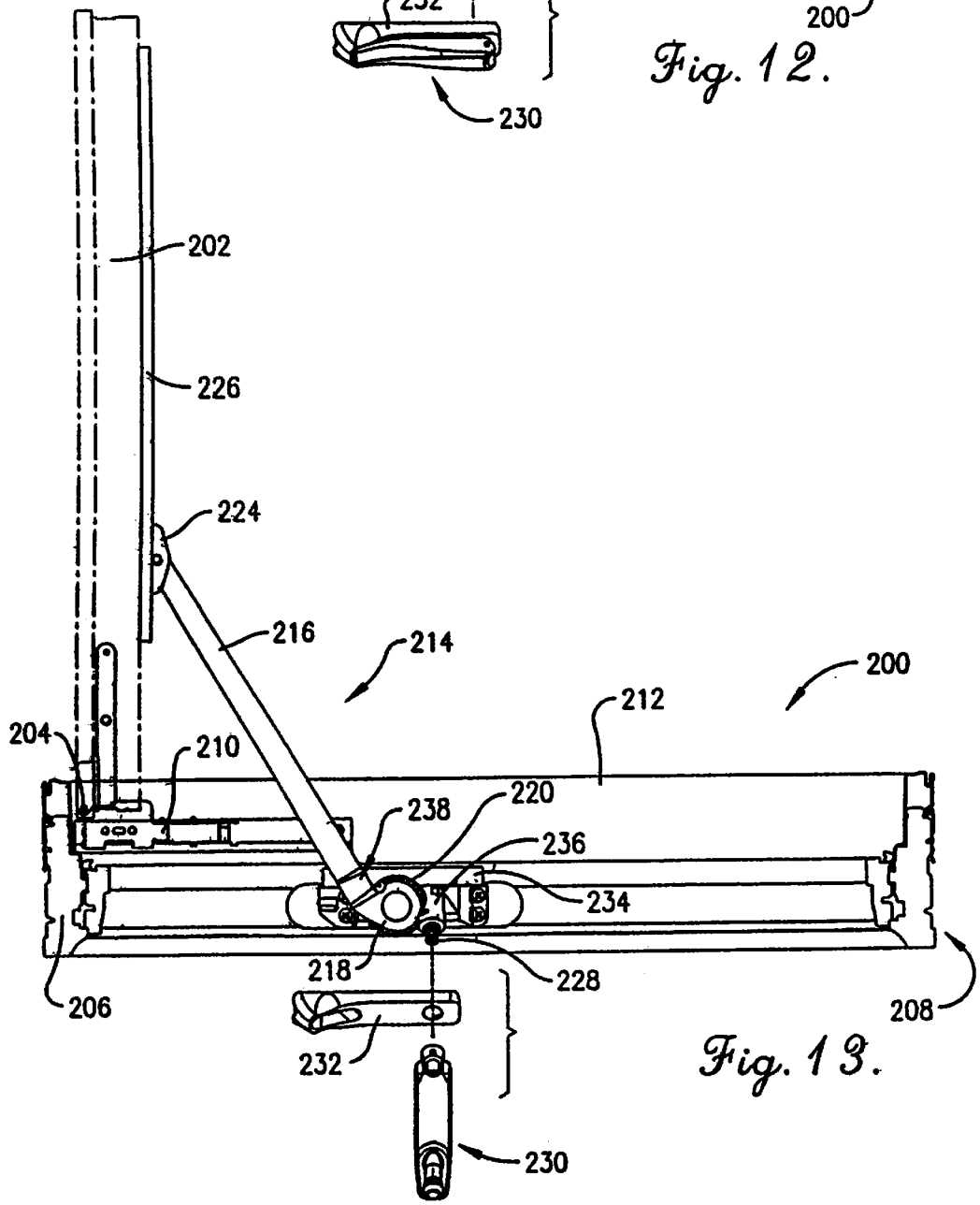
FIG. 13 is a fragmentary top plan view similar to FIG. 12, but showing the sash fully opened and the crank handle unfolded.
Figure 14:
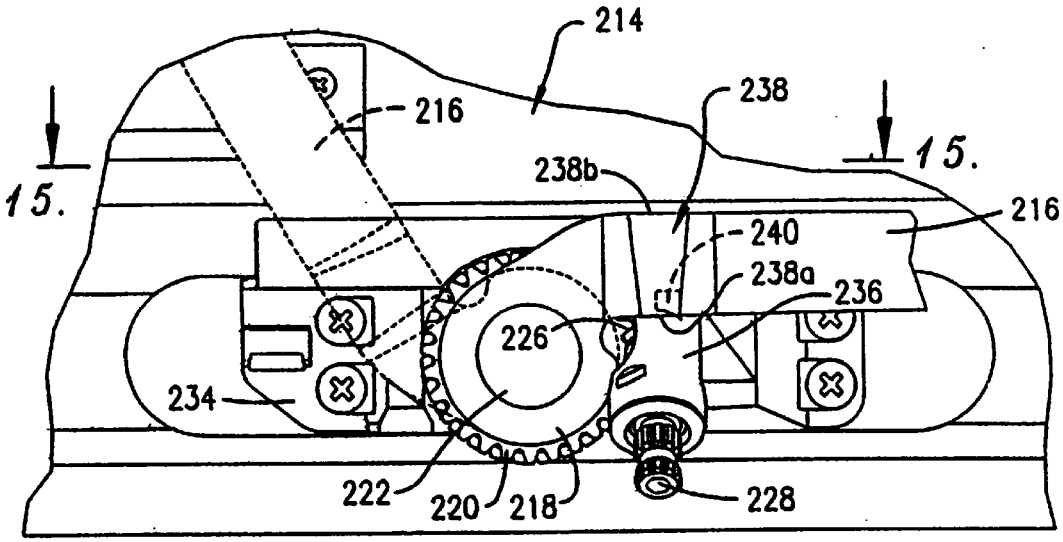
FIG. 14 is an enlarged, fragmentary top plan view of the egress operator of FIGS. 12 and 13, showing the swing link arm in its closed position, the phantom lines illustrating the opened position of the link arm.
Figure 15:
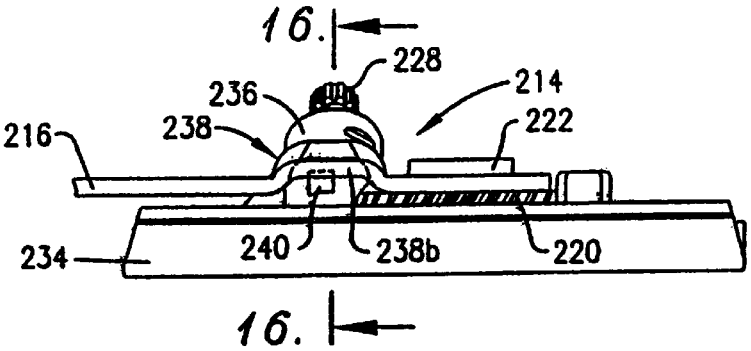
FIG. 15 is a fragmentary cross-sectional view of the egress operator taken substantially along line 15—15 of FIG. 14.
Figure 16:
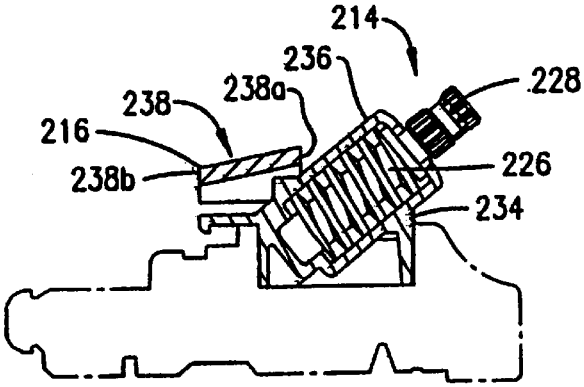
FIG. 16 is a transverse cross-sectional view of the egress operator taken substantially along line 16—16 of FIG. 15.
Figure 19:
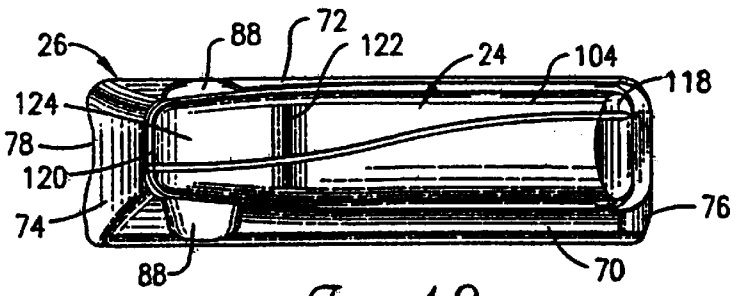
FIG. 19 is a top plan view of the folded down crank handle and cover.
Figure 20:
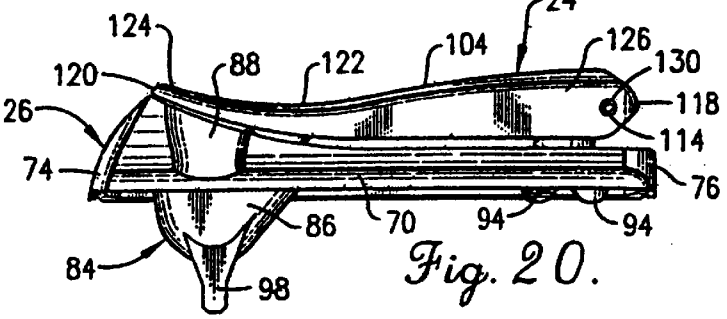
FIG. 20 is a side elevational view of one side of the folded down crank handle and cover.
Figure 21:
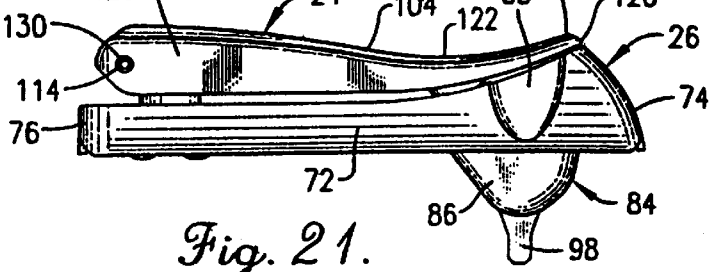
FIG. 21 is an elevational view of the opposite side of the folded down crank handle and cover.
Figure 17:
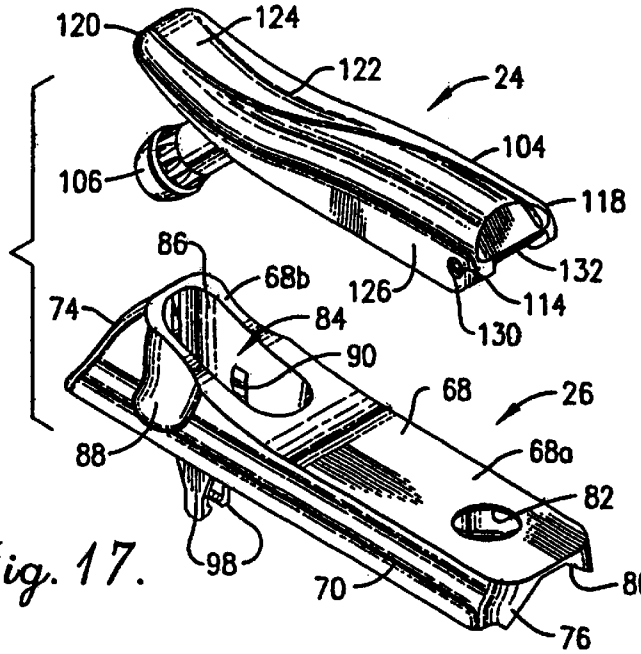
FIG. 17 is an exploded front perspective view of a preferred embodiment of the crank handle assembly and cover of the present invention.
Figure 18:
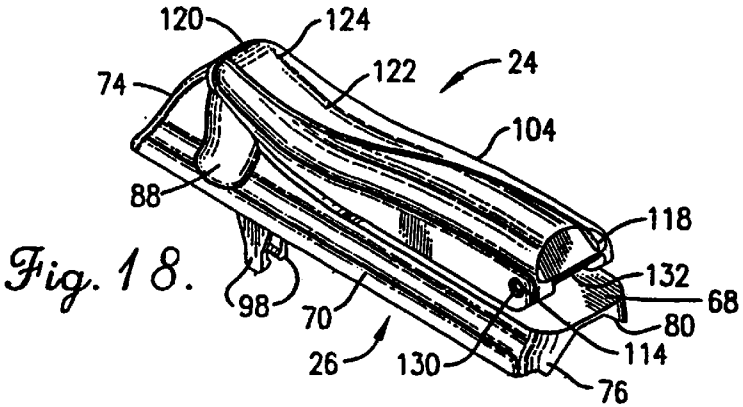
FIG. 18 is a front perspective view thereof with the handle in its folded down position.

Such an arrangement is illustrated in FIGS. 12 and 13, wherein it maybe seen that the egress casement window 200 has a sash 202 that swings about an upright pivot 204 located adjacent one of the upright frame members 206 of window frame 208. As well understood by those skilled in the art, mechanism 210 on the sill 212 of window frame 208 permits the user to selectively shift sash 202 along sill 212 and toward the center of window frame 208 for cleaning purposes when the operator has been disconnected from sash 202.

The operator assembly 214, used in connection with egress window 200, is identical in all respects to operator assembly 22, except in the area of the swing linkage that pushes and pulls sash 202 between its various positions. Thus, the egress operator assembly 214 will only be briefly described, with the understanding that most of its components and mode of operation are identical to those in operator assembly 22.

Suffice it to point out, therefore, that in lieu of swing linkage 40 associated with operator assembly 22, egress operator assembly 214 uses a swing linkage having a single long swing arm 216. At its inner end, arm 216 has a laterally offset, generally circular flange 218 that is fixed to the top surface of helical gear 220 for rotation with gear 220 about the axis of mounting stud 222. The offset relationship of flange 218 with respect to the remainder of arm 216 causes arm 216 to be disposed in an eccentric relationship to the axis of rotation of helical gear 220. At its opposite end, arm 216 is pivotally attached to a slide shoe 244 captured within a horizontal track 226 on the face of the lower, horizontally extending rail of sash 202. Thus, as helical gear 220 is rotated by worm gear 226 through drive shaft 228 by crank handle assembly 230 on the outside of cover 232, arm 216 swings about the axis of helical gear 220 and shoe 24 slides along track 226 to swing sash 202 between the closed position of FIG. 12 and the fully opened position of FIG. 13.

It will be seen that when sash 202 is in its closed position, link arm 216 overlies and extends along sill 212 generally parallel to the longitudinal axis of sill 212, and generally parallel to the longitudinal axis of base plate 234 of operator assembly 214. In this position, arm 216 crosses over housing 236 of worm gear 226, notwithstanding the fact that arm 216 lies essentially in the same plane as helical gear 220 and the lower end of worm gear housing 236. Such cross over relationship is afforded by virtue of a transversely extending clearance hump 238 in arm 216 generally adjacent flange 218, the hump 238 having a sufficient height to loop over and avoid engagement with stop 240 on worm gear housing 236 corresponding to the stop 64 of the first embodiment. Instead of engaging stop 240, the inboard edge 238*a* of hump 238 engages housing 236 at a point further outwardly along housing 236 to define the closed or fully folded position of arm 216. It will be noted that hump 238 is slightly inclined across the width of arm 216 in a manner to cause inboard edge 238*a* to be slightly higher than outboard edge 238*b*. Preferably arm 216 is constructed from flat plate metal material.

The preferred forms of the invention described above are to be used as illustration only, and should not be utilized in a limiting sense in interpreting the scope of the present invention. Obvious modifications to the exemplary embodiments, as herein above set forth, could be readily made by those skilled in the art without departing from the spirit of the present invention. Thus, the scope of the present invention should not be limited to the structures described in this application, but only by the structures described by the language of the claims and the equivalents of those structures.

What is claimed is:

1. An operating assembly for a casement window comprising:

an operator including a drive shaft having an axis operably couplable to a casement window linkage responsive to rotation of the drive shaft, the linkage adapted to swing a sash of the window between open and closed positions;

a crank handle having first and second ends, the handle including a knob at the first end and an integral flap at the first end;

a mount pivotally coupled to the second end of the handle and operably coupled to the drive shaft; and a cover having a first end, a second end and a top surface, the first end including a pocket configured to receive the knob therein and the second end including a hole, the cover configured to mount onto a member of the window from which the drive shaft protrudes with the cover positioned with respect to the operator so as to align the bole with the drive shaft, the crank handle adapted to pivot with respect to the mount from a first folded position, in which the handle overlies both the mount and cover with the knob received into the pocket, to a second unfolded position, in which the handle extends outwardly from the cover and the knob projects from the handle to facilitate winding movement of the handle about the axis of the drive shaft and resulting rotation of the drive shaft, the integral flap extending beyond the knob in both the first folded and the second unfolded positions, the handle covering the mount, the pocket and a majority of the top surface of the cover when in the first, folded position with at least a portion of the flap covering at least a portion of the pocket.

2. The operating assembly of claim 1, wherein the cover is configured to facilitate manual gripping of the handle for moving the handle out of the first, folded position.

3. The operating assembly of claim 2, wherein the cover comprises a pair of depressions positioned opposite one another near the first end of the cover, the depressions configured for finger insertion to grip the handle when lifting it out of the first position.

4. The operating assembly of claim 1, wherein the crank handle comprises a generally varying height between the first and second ends with the second end greater in height than the first end, and wherein the cover comprises a generally varying height between the first and second ends with the first end greater in height to accommodate the inclusion of the pocket, the crank handle oriented with respect to the cover such that the smaller handle first end overlies the greater cover first end so as to achieve an overall lower profile for the operating assembly.

5. The operating assembly of claim 4, wherein the crank handle and cover are matingly configured with respect to each other, such that the operating assembly has a generally uniform height at both ends.

6. The operating assembly of claim 1, wherein the cover comprises a lower edge with a portion of the lower edge configured to be generally concave, such that the cover is adapted to matingly mount to a window member having a generally convex profile.

7. The operating assembly of claim 6, wherein the cover lower edge comprises a generally oblong perimeter having first and second sides corresponding to the first and second ends of the cover and wherein concave portions of the lower edge are positioned at the first and second sides.

8. The operating assembly of claim 1, wherein the cover comprises side walls extending from the top surface toward a lower edge, the side walls defining planes that converge toward each other and define a volume extending above the top surface of the cover with the crank handle configured to reside within this volume when the handle is located in its first, folded position.

9. The operating assembly of claim 1, wherein the cover comprises a pair of sidewalls and a top wall including the top surface, the top wall spanning the sidewalls and facing the underside of the crank handle when the crank handle is in its folded position, with the top wall including the pocket, and the sidewalls including a pair of opposed depressions therein on opposite sides of the pocket to facilitate gripping of the crank handle for unfolding.

10. The operating assembly of claim 1, wherein the pocket comprises an interior wall having a detent operable to engage and yieldably retain the knob when the crank handle is in its folded position.

11. The operating assembly of claim 10, wherein the detent comprises at least one projection on the interior wall disposed to engage the knob when the crank handle is slightly outboard of its folded position, and wherein the interior wall is adapted to flex resiliently when the knob engages the projection so as to permit the knob to yieldably pass by the projection under the application of sufficient folding or unfolding force to the crank handle.

12. The operating assembly of claim 1, wherein the cover comprises a pair of sidewalls and a top wall including the top surface, the top wall spanning the sidewalls and facing the underside of the crank handle when the crank handle is in its folded position, with the top wall including the pocket and the pocket including an interior wall having a detent operable to engage and yieldably retain the knob when the crank handle is in its folded position.

13. The operating assembly of claim 1, wherein the integral flap at the first end covers the pocket and conceals the knob when the knob is received in the pocket.

14. The operating assembly of claim 1, wherein the knob projects generally obliquely out of the plane of the crank handle and away from the mounting end thereof, with the flap being outturned with respect to the knob to provide additional clearance for gripping the knob and operating the crank handle.

15. The operating assembly of claim 1, wherein the crank handle comprises an elongated body having a length, a width and a thickness, the body tapering in thickness and curving outwardly toward the first end of the crank handle to render the flap outwardly curved and thinner than the second end of the crank handle.

16. The operating assembly of claim 1, wherein the crank handle comprises a concavity adjacent the second end thereof on the underside of the crank handle for receiving the mount when the crank handle is in its first, folded position.

17. The operating assembly of claim 1, wherein the cover presents a certain outline as viewed in top plan, with the crank handle being disposed within the outline when the crank handle is in its folded position.

18. The operating assembly of claim 1, wherein the mount and the crank handle comprise interengageable stop surfaces disposed to prevent unfolding of the crank handle beyond the unfolded position.

19. The operating assembly of claim 1, wherein a portion of the drive shaft extends through the hole in the cover.

20. The operating assembly of claim 1, wherein a portion of the mount extends through the hole in the cover.

21. The operating assembly of claim 1, wherein the mount comprises an enlarged head and a reduced diameter boss integral with the head, the boss having a smaller diameter than the hole in the cover, with the mount including a bore extending through the boss and into the head for receiving the drive shaft.

22. The operating assembly of claim 1, in combination with a casement window linkage responsive to rotation of the drive shaft, the linkage adapted to swing a sash of the window between open and closed positions, wherein the operator is coupled to the linkage.

23. A folding crank handle assembly and cover combination for an operator of a casement window, the operator including a drive shaft, the combination comprising:

a folding crank handle assembly, the handle assembly comprising:

a crank handle having first and second ends, the handle including a knob at the first end and an integral flap at the first end; and a mount pivotally coupled to the second end of the handle and operably couplable to the drive shaft; and a cover having a first end, a second end and a top surface, the first end including a pocket configured to receive the knob therein and the second end including a hole, the cover configured to mount onto a member of the window from which the drive shaft protrudes with the cover positioned with respect to the operator so as to align the hole with the drive shaft, the crank handle adapted to pivot with respect to the mount from a first folded position, in which the handle overlies both the mount and cover with the knob received into the pocket, to a second unfolded position, in which the handle extends outwardly from the cover and the knob projects from the handle to facilitate winding movement of the handle about the axis of the drive shaft and resulting rotation of the drive shaft, the integral flap extending beyond the knob in both the first folded and the second unfolded positions, the handle covering the mount, the pocket and a majority of the top surface of the cover when in the first, folded position with at least a portion of the flap covering at least a portion of the pocket.

24. The combination of claim 23, wherein the cover is configured to facilitate manual gripping of the handle for moving the handle out of the first, folded position.

25. The combination of claim 24, wherein the cover comprises a pair of depressions positioned opposite one another near the first end of the cover, the depressions configured for finger insertion to grip the handle when lifting it out of the first position.

26. The combination of claim 23, wherein the crank handle comprises a generally varying height between the first and second ends with the second end greater in height than the first end, and wherein the cover comprises a generally varying height between the first and second ends with the first end greater in height to accommodate the inclusion of the pocket, the crank handle oriented with respect to the cover such that the smaller handle first end overlies the greater cover first end so as to achieve an overall lower profile for the operating assembly.

27. The combination of claim 26, wherein the crank handle and cover are matingly configured with respect to each other, such that the operating assembly has a generally uniform height at both ends.

28. The combination of claim 23, wherein the cover comprises a lower edge with a portion of the lower edge configured to be generally concave, such that the cover is adapted to matingly mount to a window member having a generally convex profile.

29. The combination of claim 28, wherein the cover lower edge comprises a generally oblong perimeter having first and second sides corresponding to the first and second ends of the cover and wherein concave portions of the lower edge are positioned at the first and second sides.

30. The combination of claim 23, wherein the cover comprises side walls extending from the top surface toward a lower edge, the side walls defining planes that converge toward each other and define a volume extending above the top surface of the cover with the crank handle configured to reside within this volume when the handle is located in its first, folded position.

31. The combination of claim 23, wherein the cover comprises a pair of sidewalls and a top wall that includes the top surface, the top wall spanning the sidewalls and facing the underside of the crank handle when the crank handle is in its folded position, with the top wall including the pocket, and the sidewalls including a pair of opposed depressions therein on opposite sides of the pocket to facilitate gripping of the crank handle for unfolding.

32. The combination of claim 23, wherein the pocket comprises an interior wall having a detent operable to engage and yieldably retain the knob when the crank handle is in its folded position.

33. The combination of claim 32, wherein the detent comprises at least one projection on the interior wall disposed to engage the knob when the crank handle is slightly outboard of its folded position, and wherein the interior wall is adapted to flex resiliently when the knob engages the projection so as to permit the knob to yieldably pass by the projection under the application of sufficient folding or unfolding force to the crank handle.

34. The combination of claim 23, wherein the cover comprises a pair of sidewalls and a top wall that includes the top surface, the top wall spanning the sidewalls and facing the underside of the crank handle when the crank handle is in its folded position, with the top wall including the pocket and the pocket including an interior wall having a detent operable to engage and yieldably retain the knob when the crank handle is in its folded position.

35. The combination of claim 23, wherein the integral flap at the first end covers the pocket and conceals the knob when the knob is received in the pocket.

36. The combination of claim 23, wherein the knob projects generally obliquely out of the plane of the crank handle and away from the mounting end thereof, with the flap being outturned with respect to the knob to provide additional clearance for gripping the knob and operating the crank handle.

37. The combination of claim 23, wherein the crank handle comprises an elongated body having a length, a width and a thickness, the body tapering in thickness and curving outwardly toward the fist end of the crank handle to render the flap outwardly curved and thinner than the second end of the crank handle.

38. The combination of claim 23, wherein the crank handle comprises a concavity adjacent the second end thereof on the underside of the crank handle for receiving the mount when the crank handle is in its first, folded position.

39. The combination of claim 23, wherein the cover presents a certain outline as viewed in top plan, with the crank handle being disposed within the outline when the crank handle is in its folded position.

40. The combination of claim 23, wherein the mount and the crank handle comprise interengageable stop surfaces disposed to prevent unfolding of the crank handle beyond the unfolded position.

41. The combination of claim 23, wherein a portion of the mount extends through the hole in the cover.

42. The combination of claim 23, wherein the mount comprises an enlarged head and a reduced diameter boss integral with the head, the boss having a smaller diameter than the hole in the cover, with the mount including a bore extending through the boss and into the head for receiving the drive shaft.

43. The combination of claim 23, in combination with a casement window operator including a drive shaft and a linkage responsive to rotation of the drive shaft, the linkage adapted to swing a sash of the window between open and closed positions, wherein the operator is coupled to the linkage and the folding crank handle assembly and cover combination is coupled to the operator at the drive shaft.

44. An operator for the swingable sash of a casement window comprising:

a base plate having a longitudinal axis;

a helical gear mounted on the plate for rotation about a generally upright axis;

a worm gear supported by the plate in meshing engagement with the helical gear and extending generally upwardly therefrom at an oblique angle thereto;

a drive shaft fixed to and projecting axially from the worm gear for rotating the worm gear and the helical gear; and an arm fixed to the helical gear for rotation therewith between a closed sash position in which the arm lies generally parallel to the longitudinal axis of the plate and crosses over the worm gear, and an open sash position in which the arm is swung out at an angle to the longitudinal axis, the arm having a transverse clearance hump therein for clearing the worm gear when the arm crosses over the worm gear in the closed sash position.

45. The operator of claim 44, wherein the arm is constructed from flat plate material and the hump is slightly inclined across the width of the arm so as to present a high side facing the worm gear when the arm is in its closed sash position and a low side facing away from the worm gear when the arm is in its closed sash position.

* * * * *